United States Patent [19]

Gosset

[11] 4,398,122

[45] Aug. 9, 1983

[54] MULTISTAGE DEPRESSED COLLECTOR FOR MICROWAVE TUBE

[75] Inventor: Philippe Gosset, Jouy-en-Josas, France

[73] Assignee: Thomson-CSF, Paris, France

[21] Appl. No.: 254,128

[22] Filed: Apr. 14, 1981

[30] Foreign Application Priority Data

Apr. 15, 1980 [FR] France ..... 80 08392

[51] Int. Cl.[3] ..... H01J 23/02

[52] U.S. Cl. ..... 315/5.38; 315/3.5

[58] Field of Search ..... 315/3.5, 3.6, 39.3, 315/5.38

[56] References Cited

U.S. PATENT DOCUMENTS

| | | | |
|---|---|---|---|
| 2,325,865 | 8/1943 | Litton | 315/5.38 |
| 2,610,306 | 9/1952 | Touraton et al. | 315/5.38 |
| 2,888,596 | 5/1959 | Rudenberg | 315/3.5 |
| 3,175,120 | 3/1965 | Wendt | 315/5.38 |
| 3,202,863 | 8/1965 | Dunn et al. | 315/5.38 |
| 3,368,104 | 2/1968 | McCullough | 315/5.38 |
| 3,702,951 | 11/1972 | Kosmahl | 315/5.38 |

OTHER PUBLICATIONS

"Improvement of Beam-Tube Performance by Collector Potential Depression, and a Novel Design", by Hansen, IRE Transactions on Electron Devices, Oct. 1960, pp. 282–288.

*Primary Examiner*—Saxfield Chatmon, Jr.

*Attorney, Agent, or Firm*—Cushman, Darby & Cushman

[57] ABSTRACT

The present invention relates to multistage vacuum collectors for ultra-high frequency tubes.

Each electrode of the collector comprises two walls which are axially symmetrical with respect to the beam propagation axis and which are superimposed along said axis. The retarding path of the electrons due to the decreasing potentials of the electrodes is thus located in a small volume space between the facing walls of two adjacent electrodes. A plurality of permanent magnets positioned outside the vacuum enclosure above the final electrode produce an asymmetrical magnetic field with respect to the propagation axis.

Application to travelling-wave tubes and klystrons.

4 Claims, 2 Drawing Figures

MULTISTAGE DEPRESSED COLLECTOR FOR MICROWAVE TUBE

BACKGROUND OF THE INVENTION

The present invention relates to a multistage depressed collector for a microwave tube.

The operation of microwave tubes, such as klystrons or travelling wave tubes is based on an energy exchange between an electron beam and an electromagnetic microwave. Thus, the collector of such tubes receives, except for the energy fraction transmitted to the microwave, all the energy of the electron beam and dissipates it in the form of heat. It is necessary to attempt to reduce this dissipated energy on the one hand to reduce the difficulties associated with the removal of the heat and on the other in order to increase the efficiency of such tubes.

A known solution for reducing the energy consists of using a multistage depressed collector which comprises a plurality of electrodes arranged along the path of the electron beam of the tube. At present various geometrical configurations are used for the electrodes. Fundamentally a distinction is made between electrodes axially symmetrical with respect to the propagation axis of the electron beam from the tube and asymmetrical electrodes. These electrodes are brought to decreasing voltages and of values below those of the delay line in the case of a travelling wave tube or that of the cavities in the case of a klystron. The latter electrode can be raised to the potential of the cathode of the tube.

On reaching the collector the electron beam comprises electrons of different speeds. Under the influence of the space charge the slower electrons follow a curved path and are intercepted by the first electrode. The other electrons continue their path, their speed being progressively decreased by the retarding field existing between the electrodes and they are gradually intercepted by the collector electrodes.

Thus, the electrons are collected at the lowest possible potential, because there is a sorting of the electrons as a function of their energy.

BRIEF SUMMARY OF THE INVENTION

The present invention relates to a multistage depressed collector for a microwave tube, whose electrodes are axially symmetrical with respect to the propagation axis of the electron beam. Each electrode comprises two axially symmetrical walls with respect to the progagation axis of the beam and which are superimposed along this axis. The retarding field of the electrons due to the decreasing potentials of the electrodes is consequently located in the small volume area between the facing walls of two adjacent electrodes. Moreover, one or more permanent magnets are positioned outside the vacuum enclosure containing the collector above the final electrode, in such a way as to establish an asymmetrical magnetic field with respect to the beam propagation axis.

The collector according to the invention makes it possible to significantly increase the efficiency of the tubes in which it is used.

Thus, taking account of the energy recovered by the depressed collector according to the invention, for a travelling wave tube with a 19% direct efficiency (i.e. the efficiency calculated without taking account of the energy recovered by the depressed collector) a so-called depressed efficiency of 54% was obtained, taking account of the heating and at a useful power level of 200 watts between 11.7 and 12.4 GHz.

Moreover, the collector according to the invention makes it possible to distribute the energy to be dissipated over a large surface area of the electrodes, thus preventing punctiform heating of the electrodes, as occurs with the prior art collectors.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
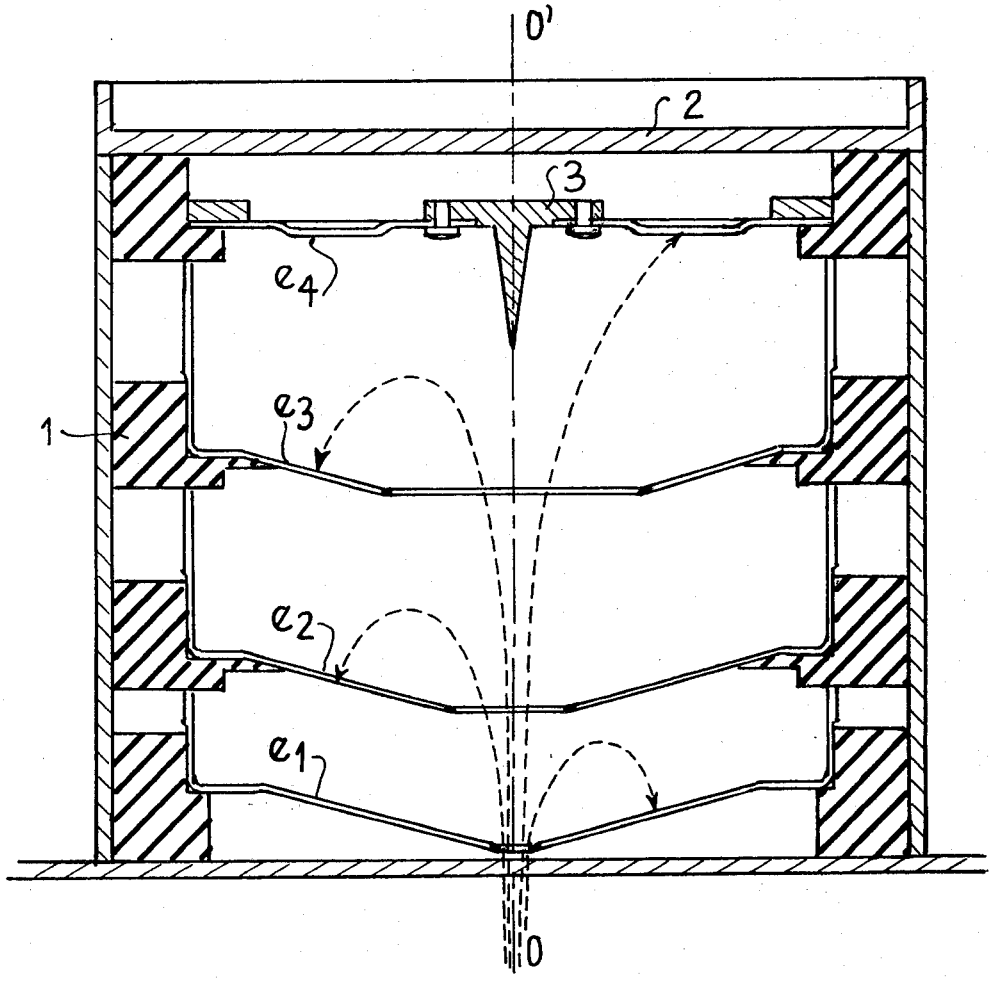
FIG. 1 a diagrammatic longitudinal sectional view of a symmetrical collector according to the prior art.

In the drawings the same references designate the same elements, but for reasons of clarity the dimensions and proportions of these different elements are not respected.

FIG. 1 is a diagrammatic longitudinal sectional view of a symmetrical collector according to the prior art. The collector of FIG. 1 has, for example, four electrodes $e_1$, $e_2$, $e_3$, $e_4$. These electrodes are axially symmetrical with respect to the propagation axis 00' of the electron beam produced by the tube associated with the collector and which is not shown in the drawing.

Apart from the final electrode $e_4$, the other electrodes $e_1$ to $e_3$ have an opening of increasing diameter permitting the passage of the beam of electrons which widens from one electrode to the next. In its centre the final electrode $e_4$ has a conical portion 3 which, in per se known manner, serves to reflect the incident beam in all directions.

By connections which are not shown in the drawing electrodes $e_1$, $e_2$, $e_3$ are raised to decreasing voltages $V_1$, $V_2$, $V_3$ and of values below that of the delay line in the case of a travelling wave tube or that of cavities in the case of a klystron. The final electrode $e_4$ can be raised to the potential of the cathode of the tube: $V_4 = V_K$.

Insulating supports 1 fix the electrodes, whilst insulating them from the metal vacuum enclosure 2. Other embodiments of depressed collectors are known in which, for example, the enclosure is insulating and the supports for the electrodes are made from metal.

In FIG. 1 a dotted line terminated by an arrow symbolically represents a number of electron paths after they have entered the collector.

In the case of the prior art collector it can be seen that the path of the electrons, whose speed is cancelled out between two electrons due to the retarding field between said electrodes, has a pronounced curvature bringing all the electrons towards the same area of the electrode of the highest potential which is inclined slightly relative to the horizontal.

Thus, there is a very significant local heating of the electrodes. Thus, it is necessary to increase the dimensions of the penultimate electrode $e_3$ compared with that of the other electrodes. This penultimate electrode receives the maximum heat to be dissipated on using the tube with small signals or without HF power at the input.

Figure 2:
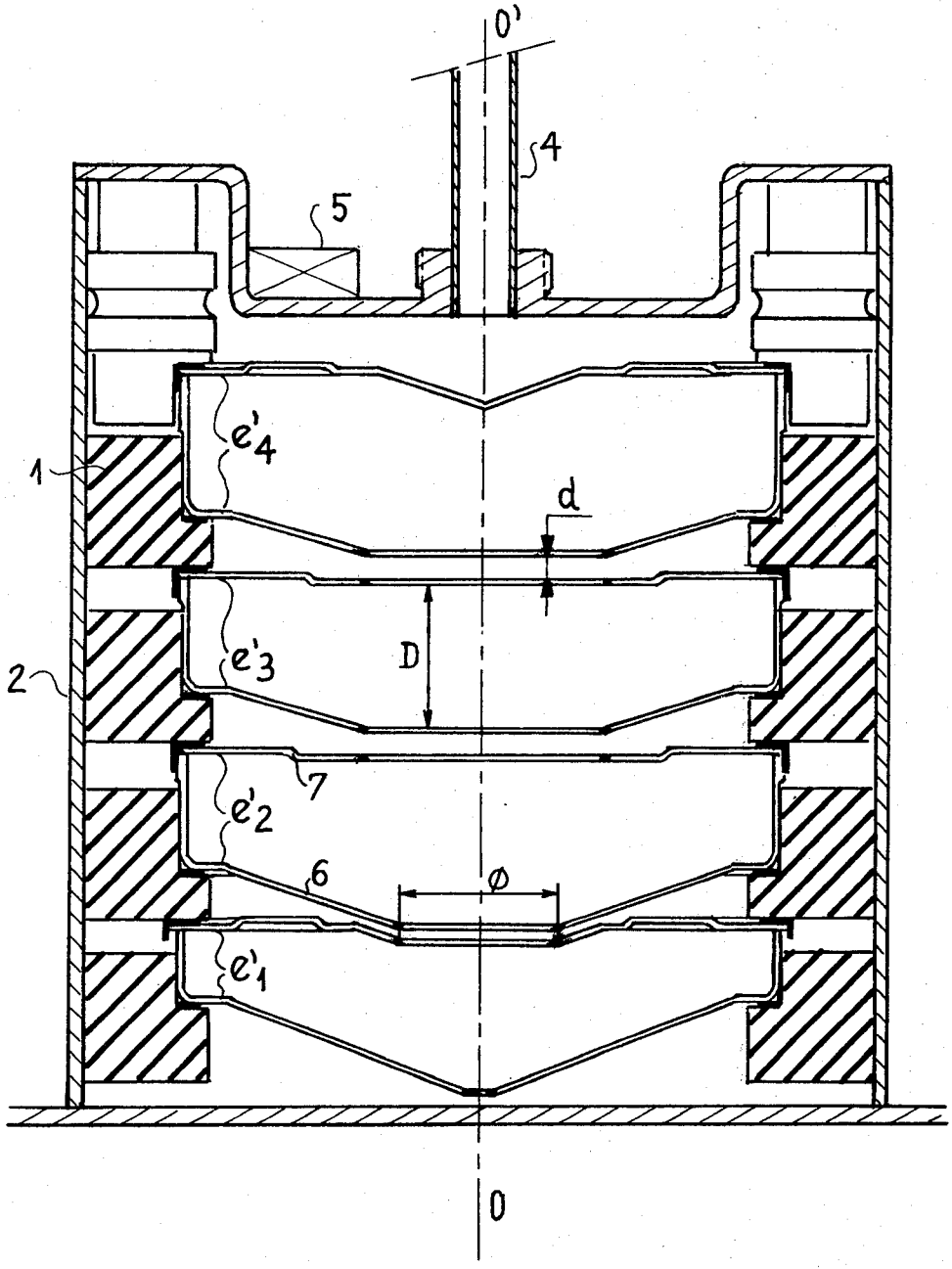
FIG. 2 a diagrammatic longitudinal sectional view of a collector according to the invention.

FIG. 2 is a diagrammatic longitudinal section of a collector according to the invention. This collector differs from that of FIG. 1 particularly on the basis of the shape of the electrodes. The electrodes are no longer constituted by a single surface to which an appropriate shape is given. The electrodes are box-shaped and are approximately constituted by a cylinder having the axis 00' for its axis and which is terminated by the side walls 6, 7. Each of these side walls is axially symmetrical with respect to the beam propagation axis 00'. The two walls of one and the same electrode are consequently superimposed along axis 00'.

FIG. 2 shows in exemplified manner four electrodes $e'_1$, $e'_2$, $e'_3$ and $e'_4$. The two side walls of each of the three first electrodes have an opening with an increasing diameter to permit the passage of the electron beam. Only the first wall of the final electrode $e'_4$ is perforated.

As with the prior art collector the electrodes are raised to decreasing voltages $V'_1$ to $V'_4$, with $V'_4$ equal to $V_K$.

It is important for the electrical field within each box-shaped electrode to be low. To this end the diameter $\phi$ of the opening made in each of the walls of one and the same electrode is made as small as possible compared with the distance D separating the two walls of said electrode, whilst remaining adequate to permit the passage of almost all the electron beam.

Thus, if the electrical field within each box-shaped electrode is defocusing (because it is decelerating) for the electron beam from the tube it is focusing (because it is accelerating) for the reflected electrons. Thus, it is advantageous for the field to be as weak as possible. Thus, the reflected electrons are exposed to a focusing field which is weaker than in the case of the prior art collector and are distributed over the electrodes. Thus, unlike in the prior art collectors there is no localized heating of the electrodes.

In the collector according to the invention the magnetic decelerating field for the electrons from the tube due to the decreasing potential of the electrodes is located in a small volume area between the facing walls of two adjacent electrodes. The distance d separating the facing walls of two adjacent electrodes is made as small as possible, whilst still being adequate to prevent any arcing between the electrodes.

Optical electronic calculations confirmed by experimental results have revealed that there is an improvement of 4 to 5 points for a 50% depressed efficiency with the collector according to the invention, whose electrodes determine small electrical field spaces and where the decelerating field between electrodes is only applied over a short distance.

This improvement is essentially due to the fact that by localizing the decelerating field there is a better control of the electron beam and more electrons are intercepted at a good potential on each electrode.

Moreover, according to the invention, one or more permanent magnets 5 are positioned outside the vacuum enclosure 2 containing the collector and above the final electrode $e'_4$. FIG. 2 shows a magnet 5 in the vicinity of an exhaust tube 4. Generally samarium-cobalt magnets are used, being arranged so as to produce an asymmetrical magnetic field with respect to the axis 00'. Thus, these magnets cause the curvature of the paths of the secondary electrons and the reflected electrons circulating in the final stage.

As the electrical field within the final electrode is weak, the secondary and reflected electrons are not focused and accelerated towards the tube, as is the case in the prior art collectors. Moreover, the existence of an asymmetrical magnetic field ensures that a high proportion of these electrons is intercepted by the final electrode $e'_4$.

It has been found that the introduction of an asymmetrical magnetic field leads to the doubling of the current collected on the final electrode $e'_4$. The energy collected on electrode $e'_4$ at potential $V_K$ is of particular interest for improving efficiency because it is to some extent free energy.

What is claimed is:

1. A multistage depressed collector for a microwave tube, comprising a plurality of electrodes positioned along the path of the electron beam of the tube and which are axially symmetrical with respect to the propagation axis (00') of the beam and which are raised to decreasing potentials, each electrode being formed of two walls which are separated along the propagation axis and each wall having an opening permitting the passage of the beam of electrons, and wherein the distance separating the facing walls of two adjacent electrodes is substantially no greater than required to prevent any arcing over between said two adjacent electrodes and the diameter of the opening in each of the walls of each electrode is substantially smaller than the distance separating the two walls of the said electrode and substantially no greater than required to permit the passage of the beam of electrons.

2. A collector according to claim 1, wherein each electrode is constituted by a cylinder, whose axis is the electron beam propagation axis (00') and which is terminated by the electrode walls.

3. A collector according to claim 2, wherein at least one permanent magnet is positioned outside the vacuum enclosure containing the collector above the final electrode, so as to produce an asymmetrical magnetic field with respect to the beam propagation axis.

4. A collector according to claim 1, wherein at least one permanent magnet is positioned outside the vacuum enclosure containing the collector above the final electrode, so as to produce an asymmetrical magnetic field with respect to the beam propagation axis.

* * * * *